US005086552A

United States Patent [19]

Moore

[11] Patent Number: 5,086,552

[45] Date of Patent: Feb. 11, 1992

[54] METHOD OF RECYCLING VEHICLE TIRES

[76] Inventor: Richard A. Moore, P.O. Box 1459, Squamish, British Columbia, Canada, V0N 3G0

[21] Appl. No.: 591,695

[22] Filed: Oct. 2, 1990

[51] Int. Cl.[5] ..... E04D 1/22

[52] U.S. Cl. ..... 29/403.1; 29/401.1; 52/518; 52/543; 52/748; 52/DIG. 9

[58] Field of Search ..... 29/401.1, 403.1; 83/920, 951; 427/186, 187; 52/DIG. 9, 748, 747, 518, 543

[56] References Cited

U.S. PATENT DOCUMENTS 3,803,792 4/1974 Fulton ..... 52/DIG. 9 X 4,694,716 9/1987 Sakamoto ..... 83/951 X

*Primary Examiner*—Joseph M. Gorski

*Attorney, Agent, or Firm*—Charles H. Thomas

[57] ABSTRACT

A method of recycling a vehicle tire comprises cutting the vehicle tire into separate pieces by radial cuts each extending from the inner periphery to the outer periphery of the tire, and securing the thus-cut tire pieces in mutually overlapping relationship as shingles to form a rain-proof covering on a building.

1 Claim, 1 Drawing Sheet

METHOD OF RECYCLING VEHICLE TIRES

FIELD OF THE INVENTION

The present invention relates to a method of recycling vehicle tires and, more particularly, to a method of utilizing cut tire pieces as shingles in building construction.

BACKGROUND OF THE INVENTION

The disposal of used vehicle tires represents a substantial and ever increasing problem, which results in substantial environmental damage, waste of money and resources and risk to persons, animal and objects as a result of fires at tire dumps.

These problems result at least partially from the fact that vehicle tires are manufactured so as to be as weather-proof and generally indestructible as possible, so that when they become worn and can no longer be used for their intended purpose, it is difficult if not impossible to dispose of them.

BRIEF SUMMARY OF THE INVENTION

It is an object of the present invention to provide a novel method of usefully recycling vehicle tires.

It is a further object of the present invention to take advantage of the near-indestructibility of vehicle tires by using pieces of tires as shingles in building construction.

According to the present invention, a method of recycling a vehicle tire comprises cutting the vehicle tire into a plurality of separate pieces by cuts each extending from the inner periphery to the outer periphery of the tire, the cuts preferably extending radially of the tire. The thus-cut tire pieces are then secured in overlapping relationship as shingles to form a rainproof covering on a building, for example on the roof and/or one or more walls of the building.

A particularly attractive appearance is achieved if the tire pieces are secured with the tread sides thereof facing inwardly of the building.

After the tire pieces have been cut, so that each piece comprises a tread portion intermediate a pair of side wall portions, the side wall portions may be bent relative to the tread portion to partially flatten the tread piece before it is utilized as a shingle.

BRIEF DESCRIPTION OF THE DRAWINGS

Further features, objects and advantages of the present invention will be more readily apparent from the following description thereof when taken in conjunction with the accompanying drawings, in which.

DESCRIPTION OF THE PREFERRED EMBODIMENTS

Figure 1:
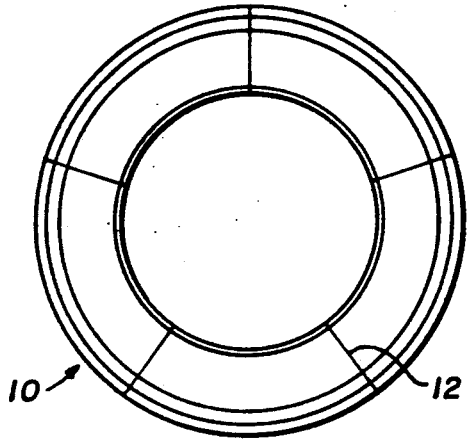
FIG. 1 shows a plan view of a vehicle tire with radial cuts formed through the tire.

Referring firstly to FIG. 1, in which reference numeral 10 indicates generally a used vehicle tire which is to be recycled, the tire 10 is firstly cut into five separate pieces by radial cuts extending radially of the tire along cut lines 12 from the inner periphery of the tire to the outer periphery thereof.

Figure 2:
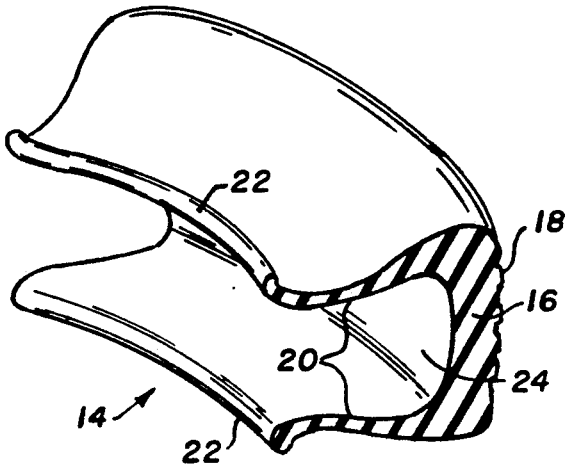
FIG. 2 shows a view in perspective of one of the pieces of the tire which are formed by the cuts in FIG. 1.

One of the cut pieces thus-obtained is shown in FIG. 2 and indicated generally by reference numeral 14.

The tire piece 14 has an intermediate tread portion 16, with an external tire tread 18, two side walls 20 extending from opposite side of the tread portion 16, and two tire bead portions 22 at the free edges of the side wall portions 20. The interior of the tire piece 14 has a smooth inner surface 24.

Figure 3:
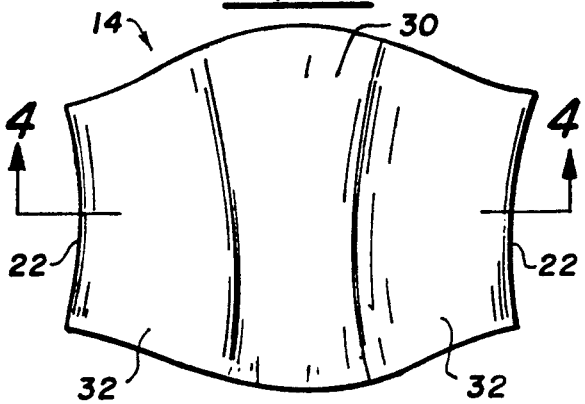
FIG. 3 shows the tire piece of FIG. 2 in a flattened condition and in plan view.
Figure 4:
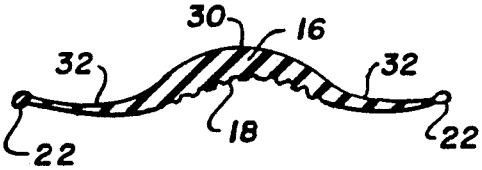
FIG. 4 shows a view taken in cross-section along the line 4—4 of FIG. 3.

By bending the side wall portions 20 relative to the tread portions 16, the tire piece 14 can be converted to the partially flattened condition in which it is shown in FIGS. 3 and 4.

Figure 5:
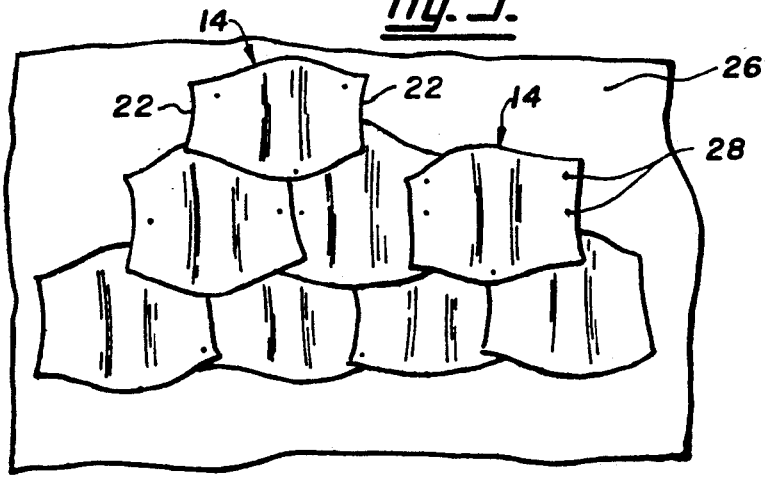
FIG. 5 shows a plurality of tire pieces such as that of FIG. 3 arranged in mutually overlapping relationship as shingles on a roof.

With the tire piece 14 in this partially flattened condition, it can be secured, by nailing, to a roof 26 as shown in FIG. 5, in which the nails securing a plurality of tire pieces such as the tire piece 14 are indicated by reference numeral 28.

In the arrangement shown in FIG. 5, the bead portions 22 of each of the tire pieces are disposed substantially vertically as viewed in FIG. 5, i.e. in the direction from the peak to the eaves of the roof.

As can be seen from FIG. 4, the partially flattened tire pieces 14 presents a central, upwardly convex surface portion 30 between a pair of upwardly concave surface portions 32.

When the tire portions are secured in over-lapping relationship as described above, as shingles, rain falling on the roof is deflected by the convex portions 30 into the concave portions 32, which serve as channels, down which the rain runs.

The tire pieces are not restricted to use as shingles for roofs but may be employed on walls or other suitable surfaces.

Whereas the inner surface 24 of the tire piece 14 presents a smooth, attractive appearance when arranged as the outwardly-facing surface of a shingle, the tire pieces may be used in reverse, i.e. with the treads 18 facing outwardly, which also presents a pleasant, but different, appearance.

I claim:

1. A method of recycling a vehicle tire having a road engaging tread portion and two opposed sidewall portions each of which terminates in a peripheral bead portion, comprising the steps of: cutting the vehicle tire into a plurality of separate pieces by performing radial cuts on the vehicle tire, each piece comprising two bead portions, to opposed sidewall portions and a tread portion; bending the opposed sidewall portions of each of the cut tire pieces relative to its tread potion, thereby forming the tire pieces into a partially flattened condition; and securing the thus-cut tire pieces in their partially flattened condition in mutually overlapping relationship as shingles on a building, thereby forming a rain-proof covering, wherein the road-engaging tread portions of the tire pieces face inwardly of the building and the bead portions of each piece are disposed substantially in a desired direction of raid drainage.

* * * * *